US005223808A

United States Patent [19]

Lee et al.

[11] Patent Number: 5,223,808

[45] Date of Patent: Jun. 29, 1993

[54] PLANAR FERRITE PHASE SHIFTER

[75] Inventors: Jar J. Lee, Irvine; James V. Strahan, Brea, both of Calif.

[73] Assignee: Hughes Aircraft Company, Los Angeles, Calif.

[21] Appl. No.: 841,394

[22] Filed: Feb. 25, 1992

[51] Int. Cl.[5] ..... H01P 1/215

[52] U.S. Cl. ..... 333/24.1; 333/161

[58] Field of Search ..... 333/24.1, 161

[56] References Cited

U.S. PATENT DOCUMENTS 3,560,893 2/1971 Wen ..... 333/24.1
3,715,692 2/1973 Reuss, Jr. ..... 333/24.1
4,152,676 5/1979 Morgenthaler et al. ..... 333/24.1
4,985,709 1/1991 Nishikawa et al. ..... 333/161 X

*Primary Examiner*—Paul Gensler
*Attorney, Agent, or Firm*—Wanda K. Denson-Low

[57] ABSTRACT

A microwave ferrite phase shifter wherein three parallel microstrip lines are disposed on a planar ferrite substrate surface opposite a ground plane disposed on an opposite planar surface of the substrate, the lines defining two sets of quadrature E-fields within the substrate to produce a circularly polarized wave therein, the amount of phase shift between the input and output ports of the phase shifter being determined by the magnitude of a magnetic field produced in the substrate in the direction of its axis by a current-carrying coil, for example.

4 Claims, 2 Drawing Sheets

PLANAR FERRITE PHASE SHIFTER

BACKGROUND

The present invention relates generally to components used in microwave transmission systems such as phased radar arrays, and more particularly to a novel low loss phase shifter printed on a ferrite substrate that advantageously operates at microwave frequencies and which has ideal characteristics for millimeter wave (MMW) applications.

It is well known that a phase shifter is a key element in phased array radar systems. It is also well known that there are two types of phase shifters used in this application, one being a diode phase shifter and the other being a ferrite phase shifter. Generally, where the application calls for operation at high frequencies (above 10 GHz) and in high power systems, a ferrite phase shifter configuration is utilized.

For instance, such ferrite devices are used to electronically steer the beam of phased array radar systems. A phased array usually consists of thousands of radiating elements, and unless subarray feeding is employed, an array antenna normally requires thousands of phase shifters. Thus, it is highly desirable to utilize low cost phase shifters for array applications.

Conventionally, a ferrite phase shifter must be packaged in a metalized ferrite bar or a ferrite loaded waveguide to support a circularly polarized (CP) wave, which is required to interact with a longitudinal magnetic field. A desired phase shift is achieved by adjusting the bias magnetic field along the axis of the ferrite bar. Problems arise in the fabrication of such devices because the cross section of the ferrite phase shifter is only a fraction of the operating wavelength. The building of such a phase shifter is very difficult and costly because most of which cost is in the machining of the waveguide and the sputtering of a metalized ferrite bar.

Prior art designs also require that a thin quarter-wave plate be inserted in the ferrite bar at the input and output ends in order to convert a linear mode into a circularly polarized mode, and vice versa. For MMW frequencies, it becomes increasingly difficult to make a (square or circular) ferrite bar as small as a pencil lead.

From the above, it should be evident that a ferrite phase shifter with a planar geometry that can utilize printed circuit technology to drastically reduce production costs, and that will advantageously operate at microwave and particularly MMW frequencies, is very desirable.

It should be noted that a ferrite phase shifter with a planar geometry has been developed in the prior art. For example, a microstrip design using a meander line approach was reported in an article entitled "Thin Ferrite Devices for Microwave Integrated Circuits" by Gerard T. Roome, and Hugh A. Hair, in IEEE Transactions on Microwave Theory and Techniques, July 1968, pp. 411–420. This configuration, however, is not very efficient because the circuit can not support a CP wave in a substantial way.

As can be seen in FIG. 8 of this reference, only a small region around the mid point of the quarter-wave segments in the meander line can support a CP wave. To be effective, a configuration that can support a CP wave in a substantial way and maximize its Faraday rotation continuously along the bias magnetic field is needed. This is exactly what the present invention provides.

In contrast to the prior art, the present invention alleviates the problems enumerated above by using three microstrip lines to support a CP wave for maximum interaction with the bias magnetic field through the ferrite substrate. Explicitly, the unique feature of this invention is the effective way to excite the required eigen modes (Right Hand Circularly Polarized [RHCP] and Left Hand Circularly Polarized [LHCP]) in a flat ferrite substrate.

SUMMARY OF THE INVENTION

In view of the foregoing factors and conditions characteristic of the prior art, it is a primary objective of the present invention to provide a new and improved planar ferrite phase shifter. It is another objective of the present invention to provide a light weight and less bulky planar ferrite phase shifter. It is still another objective of the present invention to provide a planar ferrite phase shifter that has low loss. It is yet another objective of the present invention to provide a planar ferrite phase shifter having circuit elements printed on a ferrite substrate. It is still a further objective of the present invention to provide a planar ferrite phase shifter that is advantageously adapted to operate at any microwave frequency and especially in MMW applications. Another objective of the present invention is to provide a planar ferrite phase shifter that utilizes planar geometry to make it possible to use printed circuit technology to significantly reduce the production cost of ferrite phase shifters. Still another objective of the present invention is to provide a ferrite phase shifter that provides more phase shift within a short distance than can be obtained in prior art microwave ferrite phase shifters. Yet another objective of this invention is to provide a planar ferrite phase shifter that exhibits 360° of phase shift in a structure having a ferrite section less than a few wavelengths long.

In accordance with an embodiment of the present invention, a planar ferrite phase shifter has an input port, an output port, and an elongated ferrite substrate having an elongated axis and opposite parallel planar first and second surfaces. First, second or central, and third parallel spaced microstrip lines are disposed on the first surface of the ferrite substrate, these lines being parallel to the elongated axis. The invention also includes an elongated conductive ground plane disposed on the second surface of the ferrite substrate, the central line and the ground plane defining a first pair of transmission lines supporting a basically vertical E-field in the substrate. Also, means are provided for respectively phase offsetting the first and third lines by 90° and −90° with respect to the central microstrip line to define a second pair of transmission lines supporting a horizontal E-field in the substrate. These two sets of transmission lines have input ends coupled to the input port of the phase shifter and opposite output ends coupled to the phase shifter's output port. These sets of transmission lines also define quadrature phases creating a circularly polarized wave in the ferrite substrate. The invention further includes phase shift means coupled to the substrate for magnetizing the substrate along its axis by a desired amount and controlling phase shift between the input and output ports of the phase shifter.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
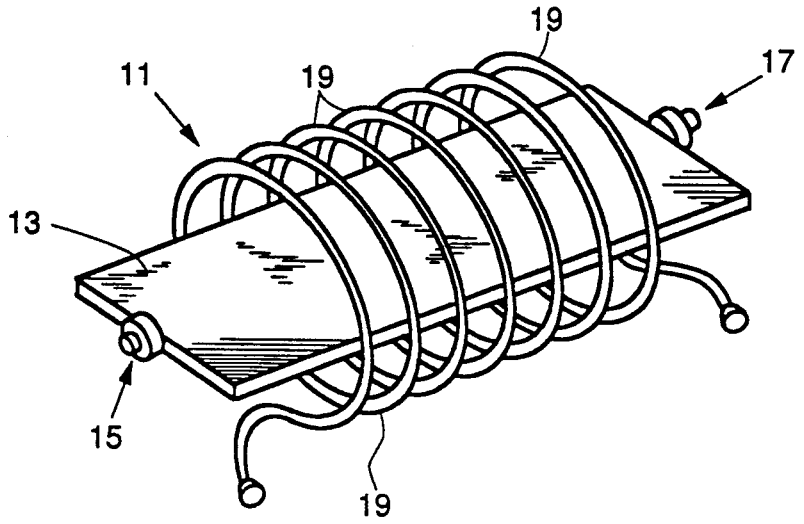
FIG. 1 is a perspective view of an embodiment of the planar ferrite phase shifter constructed in accordance with the present invention.

Referring now to the drawings, and more particularly to FIG. 1, there is shown a planar ferrite phase shifter 11 having a planar ferrite substrate 13, an input port 15, and output port 17, and a current-conductive coil 19 wound around the length of the ferrite substrate 13, the coil producing a magnetic field along the axis of the substrate when energized, and being coupled to a conventional controllable source of DC current, not shown.

Figure 2:
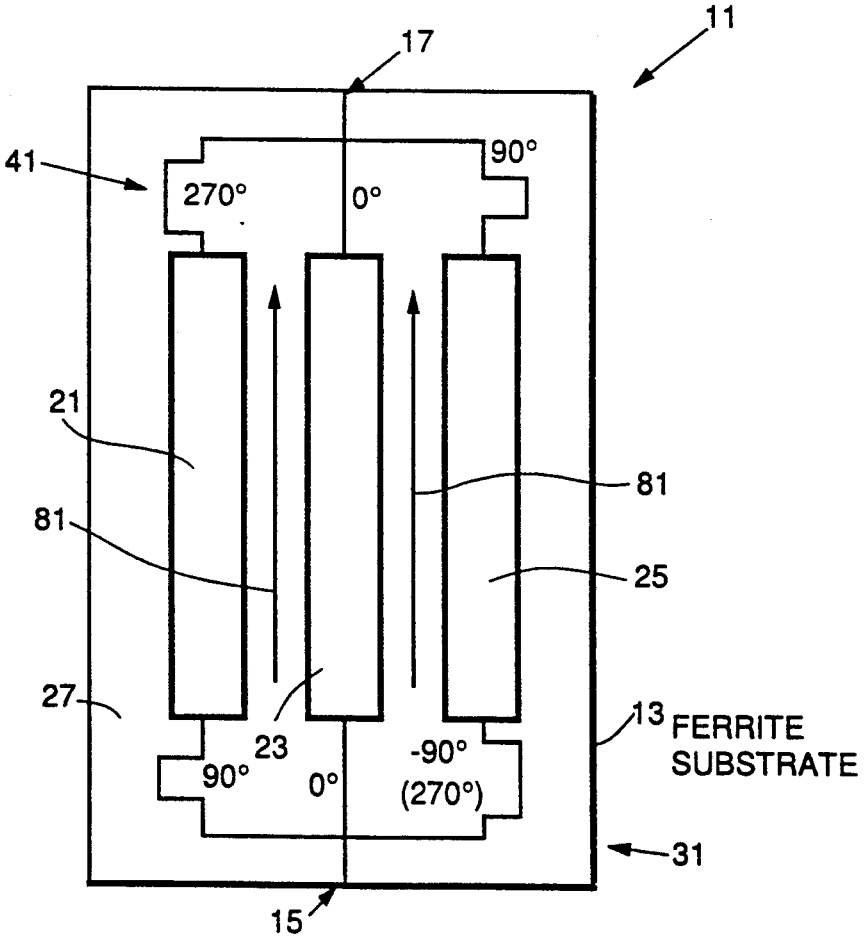
FIG. 2 is a diagrammatic representation of a planar ferrite phase shifter in accordance with the present invention.

FIG. 2 illustrates a portion of the present ferrite phase shifter 11, showing an elongated first conductive microstrip line 21, a parallel elongated central microstrip line 23, and a parallel third elongated microstrip line 25 disposed by any conventional means on an upper planar surface 27 of the elongated ferrite substrate 13.

As can be seen in the schematic of FIG. 2, one end of each of the three microstrip lines is coupled through conventional three-way power divider circuitry, generally designated 31, to the input port 15. That is, the input end of the first line 21 has a 90° phase relationship with respect to the input end of the central microstrip line 23, while the input end of the third line 25 has a −90° or 270° phase relationship to the input end of the same central line 23.

Similarly, the opposite output ends of the microstrip lines are coupled through conventional three-way power combiner circuitry 41 to the output port 17. Here, however, a −90° or 270° phase shift is provided between the output end of the first line 21 (with respect to the output end of the central line 23 (0°), and a 90° phase shift relationship is provided between the output end of the third line 25 and the 0° output end of the central line 23. It should here be noted that although the presently preferred embodiment of the invention locates the power divider circuitry directly on the ferrite substrate, other means that will provide the proper phase relationship, as above described, may be substituted.

Figure 3:
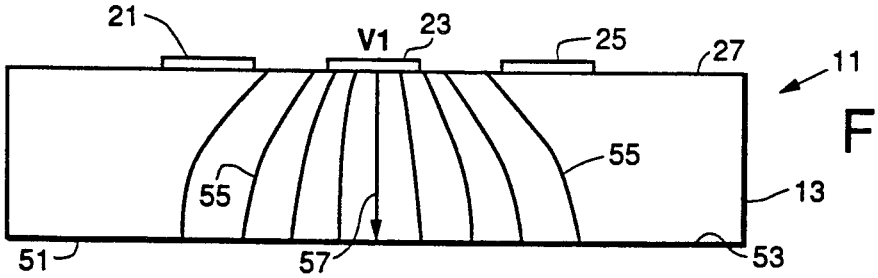
FIG. 3 is an end elevational view of the ferrite phase shifter of FIG. 2, showing vertical E-field supported in the ferrite substrate.
Figure 4:
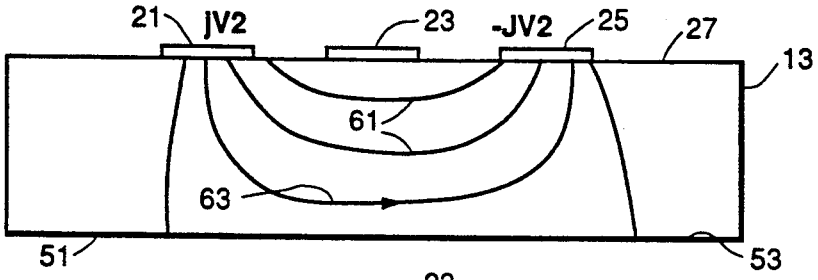
FIG. 4 is an end elevational view of the ferrite phase shifter of FIG. 2, showing the horizontal E-field in the substrate.
Figure 5:
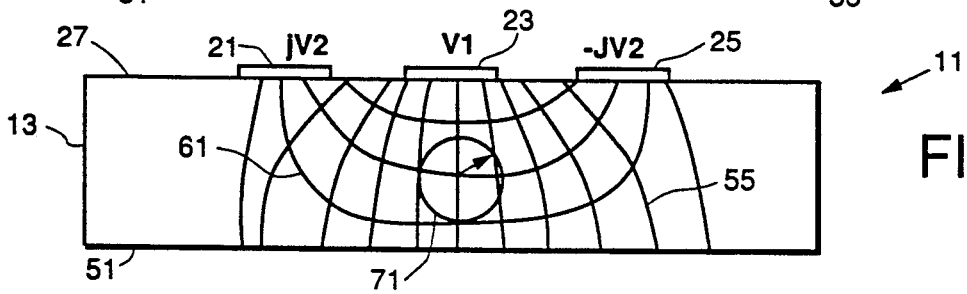
FIG. 5 is also an end elevational view of the ferrite phase shifter of FIG. 2, showing the quadrature phases set up by the E-fields shown in FIGS. 3 and 4, creating a circularly polarized (CP) wave in the ferrite substrate.

As best viewed in FIGS. 3–5, the ferrite phase shifter 11 also includes a conductive planar ground plane 51 that is disposed on a lower planer surface 53 of the ferrite substrate 13 by any conventional means, which surface 53 is generally parallel to the substrate's upper planar surface 27. The central microstrip line 23 and the ground plane 51 define a first pair of transmission lines adapted to support a basically vertical E-field, denoted in FIG. 3 by lines 55 and having a direction indicated by arrow 57.

On the other hand, the two side microstrip lines 21 and 25 are offset in phase, respectively, by 90° and −90° with respect to the central 0° line 23 (as noted previously) to define another set of transmission lines in order to support a horizontal E-field 61 in a direction indicated by arrow 63 in FIG. 4. These two sets of transmissions lines, with quadrature phases, create a circularly polarized (CP) wave 71 in the ferrite substrate 13 as shown in FIG. 5.

In this embodiment of the invention, the ferrite substrate 13 is magnetized along its elongated axis, as indicated by lines 81 (FIG. 2), by the current-carrying winding 19 wrapped (or printed) around the substrate 13 in a conventional manner. The desired phase shift of the shifter 11 is obtained by adjusting the bias magnetic field 81, which is controlled by the current flow in the coil or winding 19.

It should be noted that the circuit configuration of the phase shifter 11 can be optimized to achieve maximum phase shift, by varying such parameters as the width of each microstrip line conductor, the thickness of the substrate, the gap between the microstrip lines, and the line voltages on the transmission lines $V_1$ on line 23, $jV_2$ and $-jV_2$ on lines 21 and 25, respectively), as is well known by those skilled in this art.

Figure 6:
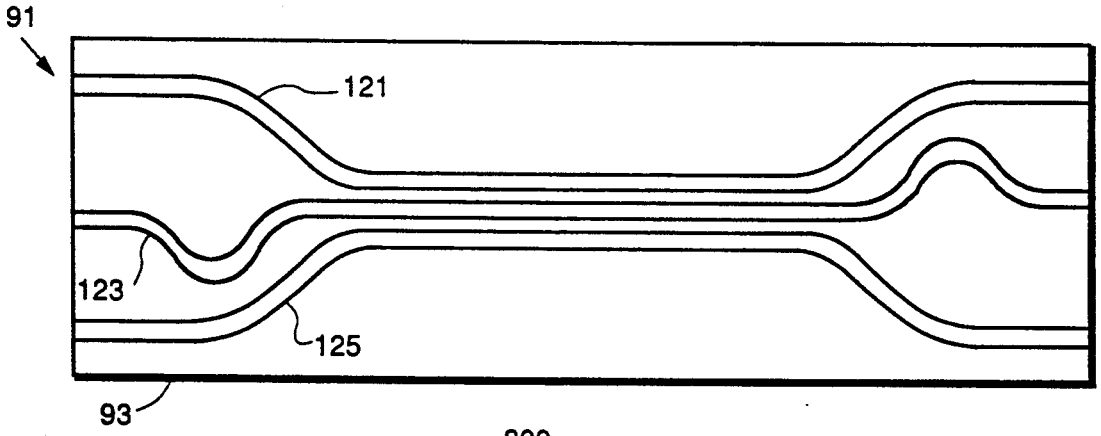
FIG. 6 is a plan view of the upper plated surface of a planar ferrite substrate of an S-band ferrite phase shifter prototype in accordance with an embodiment of the present invention.

A test of an S-band ferrite phase shifter prototype embodiment 91 of the invention is illustrated in FIG. 6. Here, the power divider and combiner circuits are external of the ferrite substrate 93 and are coupled by conventional couplings to the associated ends of a first microstrip line 121, a central microstrip line 123, and a third microstrip line 125.

Figure 7:
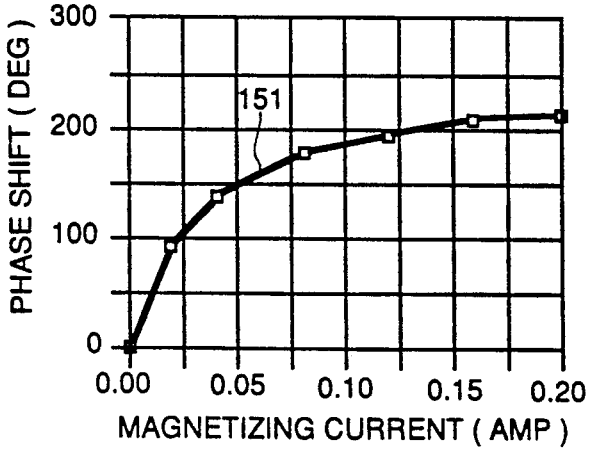
FIG. 7 is a graphical representation showing the relationship between measured phase shift against bias magnetic field current for a planar ferrite phase shifter constructed in accordance with the present invention.

The width of the lines are 0.110", the gap between the lines is 0.050", the thickness of the ferrite substrate is 0.126", the total length of the substrate is 3.0", and the $\epsilon_r$ (dielectric constant) and $K_{eff}$ (effective dielectric constant) are respectively equal to 11.3 and 8.2. The measured phase shift vs bias magnetic field for the prototype of FIG. 6 is shown by curved line 151 in the graph of FIG. 7. The result is considered to be remarkable in that a conventional design can not produce so much phase shift within such a short distance. A conventional ferrite phase shifter would have been driven into saturation long before so much phase shift could be obtained.

From the foregoing it should be understood that there has been described a new and improved planar ferrite phase shifter that is light in weight, less bulky, more efficient and that will provide greater phase shift than can be obtained from prior art ferrite phase shifters. Also, the present invention utilizes planar geometry to reduce production costs of ferrite phase shifters, and that effectively operates in the MMW range to provide 360° of phase shift in a structure having a ferrite section less than a few wavelengths long.

It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A planar ferrite phase shifter having an input port and an output port, comprising:

an elongated ferrite substrate having opposite parallel planar first and second surfaces and an elongated axis;

a first microstrip line, a central microstrip line, and a third microstrip line disposed on said first surface of said ferrite substrate, said microstrips being equally spaced and parallel to said elongated axis;

an elongated conductive ground plane disposed on said second surface of said ferrite surface, said central line and said ground plane defining a first pair of transmission lines having input ends and supporting a basically vertical E-field in said substrate, said first and third lines being offset by 90° and −90° at their input ends, respectively, with respect to said central line and defining a second pair of transmission lines supporting a horizontal E-field in said substrate, said two sets of transmission lines having input ends coupled to the input port of the phase shifter and having opposite output ends coupled to the phase shifter's output port, these sets of transmission lines defining quadrature phases creating a circularly polarized wave in said ferrite substrate; and phase shift means coupled to said substrate for magnetizing said substrate along said axis and controlling phase shift between the input and output ports of the phase shifter.

2. The planar ferrite phase shifter according to claim 1, also comprising phase offset circuitry including a three-way power divider coupled between the input port and said input ends of said transmission lines, and a three-way power combiner coupled between the output ends of said transmission lines and the output port.

3. The planar ferrite phase shifter according to claim 2, wherein said power divider and combiner circuits are thin conductive structures disposed directly on said first planar surface of said ferrite substrate.

4. The planar ferrite phase shifter according to claim 1, wherein said phase shift means includes a coil disposed about said ferrite substrate.

* * * * *